US005388822A

United States Patent [19]

Cassady

[11] Patent Number: 5,388,822

[45] Date of Patent: Feb. 14, 1995

[54] ATTACHMENT FOR A BAT

[76] Inventor: Howard A. Cassady, 539 Severn Ave., Tampa, Fla.

[21] Appl. No.: 895,184

[22] Filed: Jun. 5, 1992

Related U.S. Application Data

[63] Continuation of Ser. No. 516,686, Jun. 4, 1990, abandoned.

[51] Int. Cl.[6] ..... A63B 69/40

[52] U.S. Cl. ..... 273/26 R; 294/19.2; 293/81.4

[58] Field of Search ..... 294/19.2; 273/26 B, 273/32 F, 81.4, 81.5, 81.6

[56] References Cited

U.S. PATENT DOCUMENTS

| | | | |
|---|---|---|---|
| 1,674,294 | 6/1928 | O'Rourke | 294/19.2 |
| 1,723,709 | 8/1929 | Reiser | 294/19.2 |
| 2,135,232 | 11/1938 | Dawn | 294/19.2 |
| 3,224,781 | 12/1965 | Hutchinson | 294/19.2 |
| 3,434,753 | 3/1969 | Croes | 294/19.2 |
| 4,006,900 | 2/1977 | ViVito | 273/26 B |
| 4,254,981 | 3/1981 | Wilson | 294/19.2 |
| 4,313,604 | 2/1982 | Baxter | 294/19.2 |
| 4,313,632 | 2/1982 | King | 294/19.2 |
| 4,733,681 | 3/1988 | Lee | 273/32 F |
| 4,789,161 | 12/1988 | Waskelo | 273/26 B |
| 5,165,744 | 11/1992 | Vogrin | 294/19.2 |

FOREIGN PATENT DOCUMENTS

| | | | |
|---|---|---|---|
| 699300 | 12/1964 | Canada | 273/26 B |

*Primary Examiner*—Theatrice Brown
*Attorney, Agent, or Firm*—Lalos & Keegan

[57] ABSTRACT

An attachment for a bat, the attachment being adapted to receive and release a ball. The attachment comprises a strap surrounding at least a portion of the upper end of the bat and forming a sleeve for receiving the upper end therein and a pair of tubular arms for receiving and releasing the ball, each of the pair of arms including a lip at the end thereof. The attachment is secured to the bat. The pair of tubular arms are secured to and project from the strap and also projecting from the upper end of the bat when the bat is received within the strap.

3 Claims, 2 Drawing Sheets

ATTACHMENT FOR A BAT

This application is a continuation of Ser. No. 07/516,686, filed Jun. 4, 1990 (ABANDONED).

BACKGROUND OF THE INVENTION

The present invention relates to a sporting apparatus, and more particularly, to an attachment for baseball or softball bats.

Mastering the skills of baseball requires frequent and repetitive practice. Without the aid of devices, another player, coach or person must pick up the ball by hand and flip or toss the ball to the hitter. Prior art devices include a batting tee and a soft toss machine. A batting tee requires the hitter to bend over to pick the ball up and place it on the tee and then hit the ball off of the tee. An alternative is the soft toss machine, in which a ball rolls down a track, hits a bump at the end of the track and bounces up so a batter can hit the ball in the air about one or two fee away from the track. The machine is often prohibitively expensive for use by little leagues or public schools.

SUMMARY OF THE INVENTION

The present invention is a device which fits on the end of a bat enabling a player to retrieve and hit the ball without the help of anyone or anything. The device can be attached to a bat with a rubber collar or by any state of the art method.

The device of the present invention aids boys and girls of all ages in perfecting their hand and eye coordination while improving their batting skills without requiring the help of another person or the assistance of a hitting tee or a soft toss machine.

DESCRIPTION OF THE PREFERRED EMBODIMENTS

Figure 1:
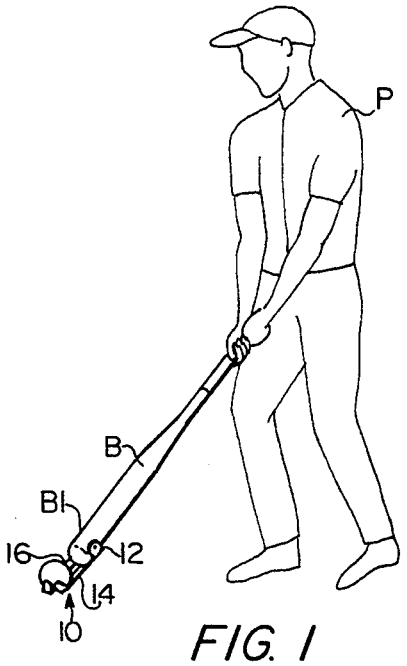
FIGS. 1–4 show a preferred embodiment of the present invention as used by a batter.
Figure 2:
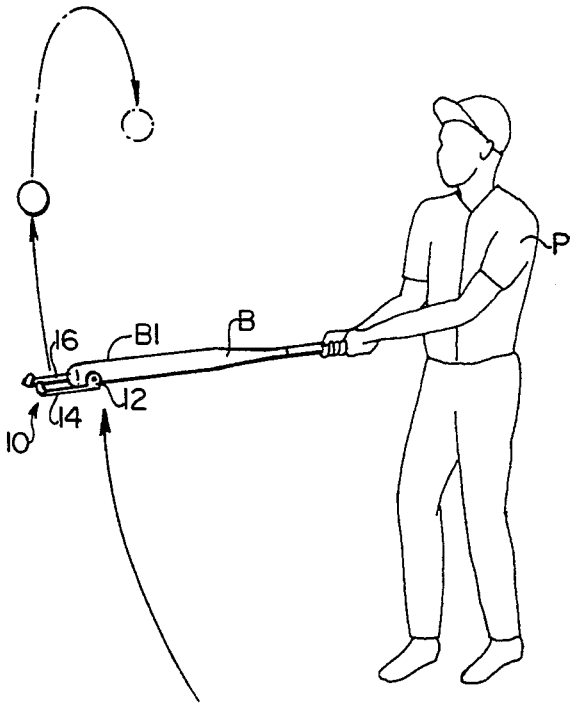
Figure 3:
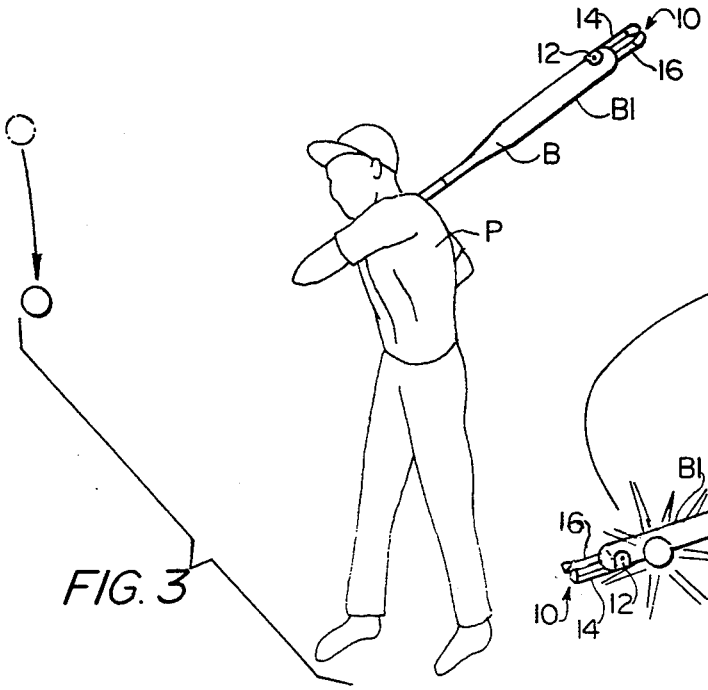
Figure 4:
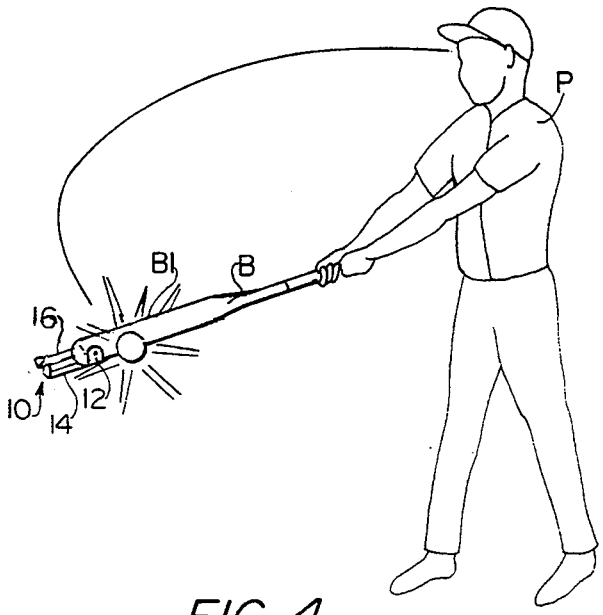

Referring to the illustration of the present invention shown in FIGS. 1–4, a ball player P is shown with a bat B upon which an attachment, shown generally as 10, is placed according to the present invention. As seen in FIGS. 1–4, attachment 10 is mounted at un upper end B1 of the bat and generally includes a strap 12 and pair of tubular arms 14 and 16. In FIG. 1, it can be seen that player P is retrieving the ball by scooping the ball between the pair of tubular arms 14 and 16. In FIG. 2, the player P is shown swinging the bat and attachment 10 such that the ball is flipped into the air. FIG. 3 shown the player P setting up in preparation for hitting the ball, and FIG. 4 shows the player P actually swinging at and hitting the ball.

Figure 5:
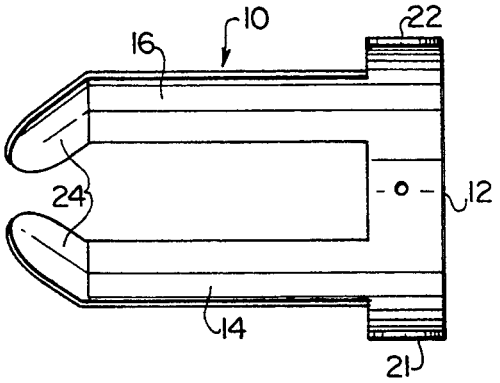
FIGS. 5 is a plan view of the embodiment of FIGS. 1–4.
Figure 6:
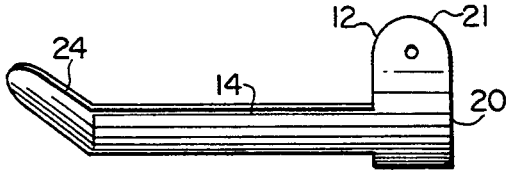
FIG. 6 is a side view of the embodiment of FIGS. 1–5.
Figure 7:
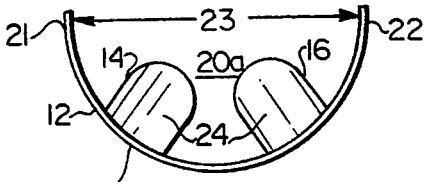
FIG. 7 is an end view of the embodiment of FIGS. 1–6.

Referring to FIGS. 5–7, it can be seen that an embodiment of the present invention is a one-piece rigid integral unit. The attachment 10 of FIGS. 5–7 includes a semi-circular strap 20 from which the pair of tubular arms 14 and 16 protrude. As best seen in FIG. 7, strap 20 includes two ends 21 and 22 and forms a cavity **20*a* having a free diameter 23. As shown in FIGS. 1–4, the upper end B1 of the bat B is received in the cavity 20*a* and is held in place by the two ends 21 and 22** clamping against the bat.

As best seen in FIG. 7, arm 14 and 16 are spaced about the circumference of strap 20 and project therefrom. Referring to FIG. 6, it can be seen that arms 14 and 16 each includes a lip 24 at the end thereof. When the ball is received between arms 14 and 16 as shown in FIG. 1, lip 24 retains the ball within the arms. Lip 24 can project at an angle from arms 14 and 16, as is shown in FIG. 6, or alternatively may be a curved portion formed at the end of arms 14 and 16, as shown in FIG. 9.

Figure 8:
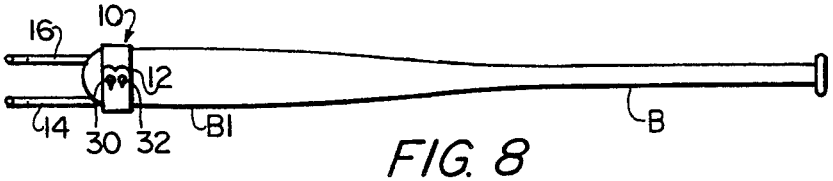
FIG. 8 is a plan view of an alternate embodiment of the present invention as installed on a bat.
Figure 9:
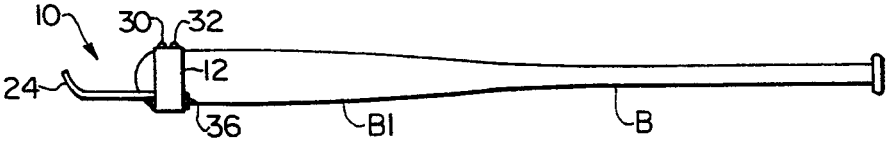
FIG. 9 is a side view of the embodiment of FIG. 8.
Figure 10:
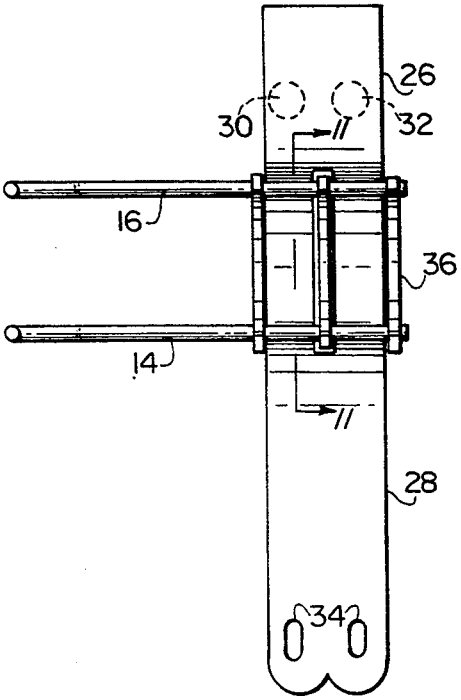
FIG. 10 is a detail view of the embodiment of FIGS. 8 and 9.

A second embodiment of the present invention is illustrated in FIGS. 8–11. In this embodiment, strap 12 completely surrounds the upper end B1 of the bat B and includes two ends 26 and 28. A fastening means 30 is provided for securing ends 26 and 28 to one another. As seen in FIGS. 8–10, fastening means 30 is preferably a button and buttonhole type arrangement. For this arrangement, fastening means 30 includes at least one button 32 projecting from end 26 and at least one elongated opening 34 disposed on end 28. When the attachment is positioned on the bat as shown in FIGS. 8 and 9, button 32 is received within elongated opening 34.

Figure 11:
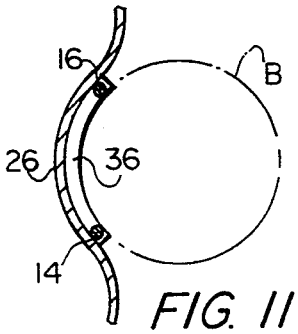
FIG. 11 is a detail view of the embodiment of FIGS. 8–10 with the strap omitted for clarity.

In this alternative embodiment, arms 14 and 16 are not integral with strap 12 but rather are a separate unit. As best seen in FIGS. 10 and 11, arms 14 and 16 are secured to one another by a support 36. As seen in FIG. 11, support 36 is contoured similarly to bat B so as to rest adjacent thereto. Support 36 may be secured to strap 12 by any conventional means or may simply be held in place by strap 12 when placed and secured around the bat B.

Both the one-piece rigid integral unit of FIGS. 5–7, the arms 14, 16 and support 36 of FIGS. 8–11 may be made by injection molding of any suitable thermoplastic. The strap 26 of FIGS. 8–11 is preferably made of a thermoplastic rubber material sold by Shell Chemical Co. under the trade name "Kraton."

From the foregoing detailed description, it will be evident that there are a number of changes, adaptations and modifications of the present invention which come within the province of those having ordinary skill in the art to which the aforementioned invention pertains. However, it is intended that all such variations not departing from the spirit of the invention be considered as within the scope thereof, limited solely by the appended claims.

I claim:

1. An attachment for a baseball or softball bat having a handle end and a ball contact end, the attachment being adapted to receive and release a ball, the attachment comprising:

a strap surrounding at least a portion of the ball contact end of the bat;

means secured to the strap for receiving and releasing a ball, said means comprising a pair of spaced apart, substantially parallel arms having one end thereof secured to and projecting from said strap and projecting from the ball contact end of the bat when the bat is received within the strap, each of said arms extending substantially parallel to the longitudinal axis of the bat and having an off-set lip portion at the end thereof; and means for securing strap to the bat.

2. An attachment according to claim 1, wherein said strap has a semi-cylindrical shape.

3. An attachment according to claim 1, wherein the pair of arms are integral with the strap.

* * * * *